US005302505A

United States Patent [19]

Delfino et al.

[11] Patent Number: 5,302,505

[45] Date of Patent: Apr. 12, 1994

[54] LIGHT-SENSITIVE SILVER HALIDE PHOTOGRAPHIC ELEMENT

[75] Inventors: Gerolamo Delfino; Milena Debenedetti, both of Savona; Marco Bucci, Genoa; Dino Ferrari, Millesimo, all of Italy

[73] Assignee: Minnesota Mining and Manufacturing Company, St. Paul, Minn.

[21] Appl. No.: 20,987

[22] Filed: Feb. 22, 1993

[30] Foreign Application Priority Data

Mar. 6, 1992 [IT] Italy ..... MI92 A 000502

[51] Int. Cl.[5] ..... G03C 1/035

[52] U.S. Cl. ..... 430/567; 430/636; 430/642; 430/963

[58] Field of Search ..... 430/567, 636, 642, 963

[56] References Cited

U.S. PATENT DOCUMENTS 4,847,189 7/1989 Suzuki et al. ..... 430/567

5,112,731 5/1992 Migasaka ..... 430/567

*Primary Examiner*—Janet C. Baxter

*Attorney, Agent, or Firm*—Gary L. Griswold; Walter N. Kirn; Mark A. Litman

[57] ABSTRACT

Light-sensitive silver halide photographic elements are disclosed comprising a support and silver halide emulsion layer or layers, wherein at least one of said silver halide emulsion layers contains tabular silver halide grains having an average diameter:thickness ratio of at least 3:1 and highly deionized gelatin and wherein said photographic elements show a swelling index lower than 140% and a melting time of from 45 to 120 minutes.

The light-sensitive materials can be advantageously developed in hardener free developer and used in high temperature super rapid processing in automatic processors which include transporting rollers and have good physical and photographic characteristics.

15 Claims, No Drawings

LIGHT-SENSITIVE SILVER HALIDE PHOTOGRAPHIC ELEMENT

FIELD OF THE INVENTION

This invention relates to light-sensitive silver halide photographic elements and, more particularly, to light-sensitive silver halide photographic elements comprising tabular silver halide grains. The light-sensitive silver halide photographic elements of the present invention are advantageously developed with hardener free developer by super rapid processing in automatic processors which include transport rollers.

BACKGROUND OF THE INVENTION

Tabular silver halide grains are crystals possessing two major faces that are substantially parallel. The average diameter of said faces is at least three times the distance separating them (the thickness). This is generally described in the art as an aspect ratio of at least 3:1.

Silver halide photographic emulsions containing a high proportion of tabular grains have advantages of good developability, improved covering power and increased useful adsorption of sensitizing dye per weight of silver due to their high surface area-to-volume ratio. The use of such emulsions in photographic elements is disclosed in U.S. Pat. Nos. 4,425,425, 4,425,426, 4,433,048, 4,435,499, 4,439,520, and other related patents.

The use of automatic processors for the rapid processing (i.e., for a processing of from 45 to 90 sec) of light-sensitive silver halide elements including tabular silver halide grains, in particular light-sensitive silver halide elements for radio-graphic use, is known. Such elements generally include a support (usually provided with a very thin subbing layer) having coated on at least one side thereof a silver halide gelatin emulsion layer coated in turn with a gelatin protective layer. These elements are transported through the machine processing units (developing, fixing, washing and drying) by means of opposed or staggered rollers (as described, for example, in U.S. Pat. No. 3,025,779) which also have the function of squeezing liquid from the film prior to drying. In recent years the increased use of silver halide elements for radiography has led to a strong request for a reduction of processing times. If rapid processing of a film takes place, several problems can occur, such as an inadequate image density (i.e. insufficient sensitivity, contrast and maximum density), insufficient fixing, insufficient washing, and insufficient film drying. Insufficient fixing and washing of a film cause a progressive worsening of the image quality and modification of the silver tone. In order to reduce the time taken by the element to pass through the processing machine from 2 to 0.5 minutes, as particularly required in rapid processing of radiographic elements, the processing is performed at relatively higher temperatures, usually higher than 30° C., preferably between 35°–45° C., such as 38° C., and the gelatin content of the silver halide emulsions is considerably reduced as compared to that of emulsions for manual processing.

Under such conditions, even with the changes in the emulsions, the physical and photographic properties of the elements processed in an automatic processor tend to be worse. With high temperatures and in presence of such low gelatin content, for instance, the intrinsic sensitivity to pressure of the silver halide grains gets higher and the elements processed in the automatic processor show marks caused by the pressure of the transporting rollers. Such pressure marks look like higher density regions and reduce the image faithfulness.

In order to prevent pressure marking, various methods have been described in the art. To this purpose, U.S. Pat. No. 2,960,404 describes the use in the photographic elements of glycerine, ethylene glycol and the like, Japanese Pat. No. 5316/1972 describes the use of 1,4-cyclohexane dimethanol and the like, and Japanese Pat. No. 4939/1978 describes the use of trimethylol propane. Another possible method of preventing pressure marking is by increasing the degree of hardening of the gelatin layers, in particular of the external protective layers. As another method, photographic elements are known wherein an intermediate gelatin layer is interposed between the support and the emulsion layer. For example, U.S. Pat. No. 3,637,389 describes a rapid processing photographic element wherein gradation, density and sensitivity are improved by applying such an intermediate gelatin layer between the support and the emulsion layer.

However, known methods of preventing pressure marking when used in photographic elements including tabular silver halide grains have proved less effective. In particular, when the hardening degree is increased to achieve a very low swelling index and to improve its resistance to pressure desensitization, photographic characteristics are reduced. Accordingly, the problem still remains of preventing pressure marking in photographic elements including light-sensitive tabular silver halide emulsions.

U.S. Pat. No. 4,414,304 describes forehardened photographic elements, particularly radiographic elements, including at least one hydrophilic colloid emulsion layer containing tabular silver halide grains having an aspect ratio of not lower than 5:1 and a projective area of not lower than 50%. The elements require no additional hardening on development and give images of high covering power. Among gelatin hardeners, bis(-vinylsulfonylmethyl) ether, mucochloric acid and formaldehyde are described.

Japanese Pat. Appl. No. J5 9105-636 describes photographic elements comprising at least one silver halide emulsion layer containing tabular silver halide grains, the binder of at least one of the hydrophilic colloidal layers being gelatin which has jelly strength of at least 250 g. Wet coat strength of said elements is improved without reducing covering power.

Japanese Pat. Appl. No. J6 2249-140 describes photographic elements comprising at least one silver halide emulsion layer containing tabular silver halide grains and halogen substituted s-triazine type hardeners. The elements are suitable for rapid processing and have improved pressure resistance.

U.S. Pat. No. 4,847,189 describes a photographic element comprising at least one silver halide emulsion layer containing tabular silver halide grains with an aspect ratio not lower than 5:1 and showing a melting time of from 8 to 45 minutes. The melting time and the gelatin amount of the element renders the element suitable for rapid processing of 45 sec. and improves the pressure desensitization resistance.

EP 238,271 discloses a silver halide photographic material comprising at least one hydrophilic colloidal layer on a support, showing a melting time of from 8 to 45 minutes, and a water content of from 10 to 20 g/m$^2$ upon completion of the washing step. The material is preferably processed in a developing solution comprising indazole and benzotriazole derivatives. The preferred processing time is 45 sec.

U.S. Pat. No. 4,647,528 discloses a method of increasing both covering power and scratch resistance by using a particular polymeric hardener in a photographic material comprising a support coated with at least one silver halide emulsion layer containing tabular silver halide grains with an aspect ratio higher than 5:1.

However, when performing a super-rapid processing of less than 45 sec the above mentioned disadvantages are not necessarily overcome by these techniques, and thus there is still the need for a silver halide photographic material which shows good photographic and physical characteristics when processed in a super-rapid processing.

SUMMARY OF THE INVENTION

The present invention relates to a light-sensitive silver halide photographic element comprising a support and at least one silver halide emulsion layer, wherein at least one of said silver halide emulsion layers contains tabular silver halide grains having an average diameter:-thickness ratio of at least 3:1 and highly deionized gelatin and wherein said photographic element shows a swelling index lower than 140% and a melting time of from 45 to 120 minutes.

There is provided by the present invention a light-sensitive silver halide photographic element comprising a support and silver halide emulsion layer(s), wherein at least one silver halide emulsion layer contains tabular silver halide grains having an average diameter:thickness ratio of at least 3:1 and highly deionized gelatin hardened with a bi-, tri-, or tetra-vinylsulfonyl substituted organic hydroxy compound of formula $(CH_2{=}CH\text{-}SO_2{-})_n{-}A$, wherein A is an n-valent organic group containing at least one hydroxy group and n is 2,3 or 4.

The light-sensitive material of this invention can be advantageously developed in hardener free developer and used in high temperature super rapid processing in automatic processors which include transporting rollers and have good physical and photographic characteristics.

DETAILED DESCRIPTION OF THE INVENTION

The present invention relates to a light-sensitive silver halide photographic element comprising a support and silver halide emulsion layer(s), wherein at least one silver halide emulsion layer contains tabular silver halide grains having an average diameter:thickness ratio of at least 3:1 and highly deionized gelatin and wherein said photographic element shows a swelling index lower than 140% and a melting time of from 45 to 120 minutes.

As employed herein swelling index refers to the percent swell obtained by (a) conditioning the photographic element at 38° C. for 3 days at 50% relative humidity, (b) measuring the layer thickness, (c) immersing the photographic element in distilled water at 21° C. for 3 minutes, and (d) determining the percent change in layer thickness as compared to the layer thickness measured in step (b). The swelling index is represented by the following formula:

$$SW.IND = \frac{THd - THb}{THb} * 100$$

wherein $TH_d$ and $TH_b$ are respectively the thickness measured at step (d) and (b). It is preferred that the photographic element of the present invention shows a swelling index lower than 140%.

As employed herein the term melting time refers to the time from dipping into an aqueous solution of 1.5% by weight of NaOH at 50° C. a silver halide photographic material cut into a size of 1×2 cm until at least one of the silver halide emulsion layers constituting the silver halide photographic material starts to melt. Reference to this method can also be found in U.S. Pat. No. 4,847,189. It is preferred that the photographic element of the present invention shows a melting time of from 45 to 120 minutes. In a more preferred embodiment of the present invention, the melting time ranges from 45 to 70 minutes.

In the present invention, a silver halide photographic element showing the above mentioned value of melting time and swelling index can be processed in a super-rapid processing of less than 45 seconds, preferably of less than 30 seconds from the insertion of the photographic element in an automatic processor to the exit therefrom, using a hardener free developer and fixer. In these conditions the physical and photographic characteristics of the photographic element of the present invention can be equal to or better than the physical and photographic characteristics obtained with rapid processing of from 45 to 90 seconds.

In a preferred embodiment of the present invention the above mentioned values of swelling index and melting time can be satisfied by a light-sensitive silver halide photographic element comprising a support and at least one silver halide emulsion layer, wherein at least one of said silver halide emulsion layers contains tabular silver halide grains having an average diameter:thickness ratio of at least 3:1 and highly deionized gelatin hardened with a bi-, tri-, or tetra-vinylsulfonyl substituted organic hydroxy compound of formula $(CH_2{=}CH{-}SO_2{-})_n{-}A$, wherein A is an n-valent organic group containing at least one hydroxy group and n is 2, 3 or 4.

In the above general formula, the group A represents an n-valent acyclic hydrocarbon group, a 5 or 6 membered heterocyclic group containing at least one nitrogen, oxygen or sulfur atom, a 5 or 6 membered alicyclic group or an aralkylene group having at least 7 carbon atoms. Each of these A groups may either have a substituent or combine with each other through a hetero atom, for example, a nitrogen, oxygen and/or sulfur atom, or a carbonyl or carbonamido group.

In the above general formula, the group A may be advantageously any organic divalent group, preferably an acyclic hydrocarbon group such as an alkylene group having 1 to 8 carbon atoms, e.g., a methylene group, an ethylene group, a trimethylene group, a tetramethylene group, etc., or an aralkylene group having a total of 8 to 10 carbon atoms. One to three of the carbon atoms of the group defined above for A can be replaced by a hetero atom such as a nitrogen atom, an oxygen atom, a sulfur atom, etc. Also, the group A can be additionally substituted, for example, with one or more alkoxy groups having 1 to 4 carbon atoms such as a methoxy group, an ethoxy group, etc., a halogen atom such as a chlorine atom, a bromine atom, etc., an acetoxy group and the like.

The above hydroxy substituted vinylsulfonyl hardeners can be prepared using known methods, e.g., methods similar to those described in U.S. Pat. No. 4,173,481.

Examples of compounds represented by the above given formula are given below. It is, however, to be understood that the invention shall not be limited thereto.

1. $CH_2{=}CH{-}SO_2{-}CH_2{-}CH(OH){-}CH_2{-}SO_2{-}CH{=}CH_2$

2. $CH_2{=}CH{-}SO_2{-}CH_2{-}CH(OH){-}CH(OH){-}CH_2{-}SO_2{-}CH{=}CH_2$

3. $CH_2{=}CH{-}SO_2{-}CH_2{-}CH(OH){-}CH_2{-}CH(OH){-}CH_2{-}SO_2{-}CH{=}CH_2$

4. $CH_2{=}CH{-}SO_2{-}CH_2{-}CH(OH){-}CH_2{-}CH_2{-}SO_2{-}CH{=}CH_2$

5. $CH_2{=}CH{-}SO_2{-}CH_2{-}CH(OH){-}CH(OH){-}CH(OH){-}CH_2{-}SO_2{-}CH{=}CH_2$

6. $CO(CH_2{-}CH(OH){-}CH_2{-}SO_2{-}CH{=}CH_2)_2$

7. $NH(CH_2{-}CH(OH){-}CH_2{-}SO_2{-}CH{=}CH_2)_2$

8. 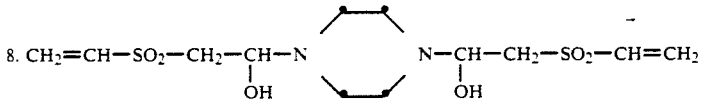

9. $CH_2{=}CH{-}SO_2{-}CH_2{-}CH_2{-}CO{-}NH{-}CH(OH){-}NH{-}CO{-}CH_2{-}CH_2{-}SO_2{-}CH{=}CH_2$

10. $CH_3{-}C(CH_2{-}CH(OH){-}CH_2{-}SO_2{-}CH{=}CH_2)_3$

11. $C(CH_2{-}CH(OH){-}CH_2{-}SO_2{-}CH{=}CH_2)_4$

12. $N(CH_2{-}CH(OH){-}CH_2{-}SO_2{-}CH{=}CH_2)_3$

13. $O(CH_2{-}CH(OH){-}CH_2{-}SO_2{-}CH{=}CH_2)_2$

14. 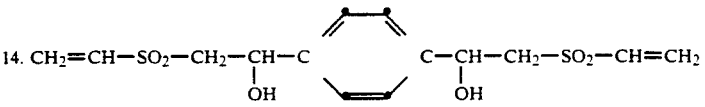

15. 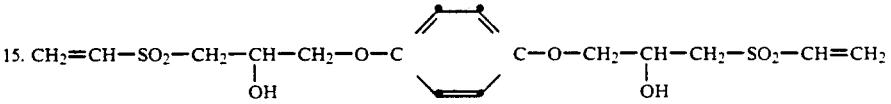

16. $CH_2{=}CH{-}SO_2{-}CH_2{-}C(OH)(CH_2{-}SO_2{-}CH{=}CH_2){-}CH_2{-}SO_2{-}CH{=}CH_2$

-continued

17.

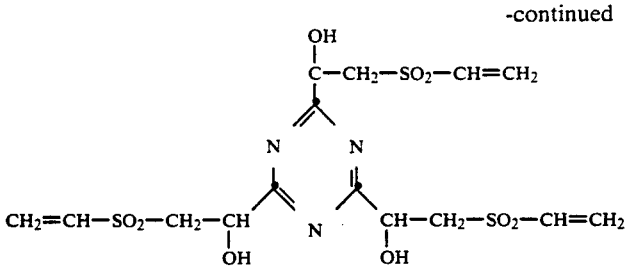

18. $(CH_2{=}CH{-}SO_2{-}CH_2{-}\underset{\underset{OH}{|}}{CH})_2CH{-}CH{-}(\underset{\underset{OH}{|}}{CH}{-}CH_2{-}SO_2{-}CH{=}CH_2)_2$ 19. $CH_2{=}CH{-}SO_2{-}CH_2{-}CH{-}OH$
$CH_2{=}CH{-}SO_2{-}CH_2{-}C{-}OH$
$CH_2{=}CH{-}SO_2{-}CH_2{-}CH{-}OH$ The above hydroxy-substituted vinylsulfonyl hardeners may be incorporated in the tabular silver halide emulsion layer comprising the deionized gelatin or in a layer of the light-sensitive silver halide photographic element having a water-permeable relationship with the tabular silver halide emulsion layer. Preferably, the hydroxy substituted vinylsulfonyl hardeners are incorporated in the tabular silver halide emulsion layer.

The amount of the above-mentioned hydroxy substituted vinylsulfonyl hardeners that is used in the tabular silver halide emulsion of the photographic material of this invention can be widely varied. Generally, the hydroxy substituted vinylsulfonyl hardener is used in amounts of from 0.5% to 10% by weight of highly deionized gelatin, although a range of from 1% to 5% by weight of highly deionized gelatin is preferred.

The values of swelling index and melting time according to the present invention can also be satisfied by using a mixture of the above-mentioned vinylsulfonyl hardeners and a conventionally known hardener, provided that the effects of the invention are not destroyed. For example, aldehyde hardeners, such as formaldehye, glutaraldehyde and the like, active halogen hardeners, such as 2,4-dichloro-6-hydroxy-1,3,5-triazine, 2-chloro-4,6-hydroxy-1,3,5-triazine and the like, active vinyl hardeners, such as bisvinylsulfonyl-methane, 1,2-vinylsulfonyl-ethane, bisvinylsulfonyl-methyl ether, 1,2-bisvinylsulfonyl-ethyl ether and the like, N-methylol hardeners, such as dimethylolurea, methyloldimethyl hydantoin and the like, provided that the invention may not affected.

The hydroxy substituted vinylsulfonyl hardeners can be added to the silver halide emulsion layer containing said tabular silver halide grains and the highly deionized gelatin or other components layers of the photographic element utilizing any of the well-known techniques in emulsion making. For example, they can be dissolved in either water or a water-miscible solvent as methanol, ethanol, etc. and added into the coating composition for the above-mentioned silver halide emulsion layer or auxiliary layers.

The highly deionized gelatin which can be used for the purposes of the present invention is characterized by a higher deionization with respect to the commonly used photographic gelatins. Preferably, the gelatin for use in the present invention is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in the silver halide emulsion layers containing tabular silver halide grains, but also in other component layers of the photographic element, such as silver halide emulsion layers containing other than tabular silver halide grains, overcoat layers, interlayers and layers positioned beneath the emulsion layers. In the present invention, preferably at least 50%, more preferably at least 70% of the total hydrophilic colloid of the photographic element comprises highly deionized gelatin. The amount of gelatin employed in the light-sensitive photographic material of the present invention is such as to provide a total silver to gelatin ratio lower than 1 (expressed as grams of Ag/grams of gelatin). In particular the silver to gelatin ratio of the silver halide emulsion layers is in the range of from 1 to 1.5.

The tabular silver halide grains contained in the silver halide emulsion layers of this invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 micrometers, preferably 0.5 to 3 micrometers, more preferably 0.8 to 1.5 micrometers. The tabular silver halide grains suitable for use in this invention have a thickness of less than 0.4 micrometers, preferably less than 0.3 micrometers and more preferably less than 0.2 micrometers.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains of the invention, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 micrometers, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No. 2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol. 5, No. 6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions containing tabular silver halide grains, a wide variety of hydrophilic dispersing agents for the silver halides can be employed in addition to the highly deionized gelatin. Gelatin as described hereinbefore is preferred, although other colloidal materials such as gelatin derivatives, colloidal albumin, cellulose derivatives or synthetic hydrophilic polymers can be used as known in the art.

The silver halide emulsions containing tabular silver halide grains used in the present invention can be chemically and optically sensitized by known methods. The silver halide emulsion layer containing the tabular silver halide grains of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The light-sensitive silver halide photographic material of this invention can be prepared by coating the light-sensitive silver halide emulsion layer or layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and other well known supports.

The light-sensitive silver halide photographic materials of this invention are applicable to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, graphic art film, etc.

Preferred light-sensitive silver halide photographic materials according to this invention are radiographic light-sensitive materials using in X-ray imaging comprising a silver halide emulsion layer(s) coated on one surface, preferably on both surfaces of a support, preferably a polyethylene terephthalate support, wherein at least one of said silver halide emulsion layers contains tabular silver halide grains having an average diameter:thickness ratio of at least 3:1 and highly deionized gelatin hardened with the above mentioned hydroxy substituted vinylsulfonyl hardeners. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens are made of relatively thick phosphor layers which transform the X-rays into more imaging-effective radiation such as light (e.g., visible light). The screens absorb a much larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes adsorbed on the surface of the silver halide grains as known in the art.

More preferred light-sensitive silver halide photographic materials according to this invention are radiographic light-sensitive materials which employ intermediate diameter:thickness ratio tabular grain silver halide emulsions, as disclosed in U.S. Pat. No. 4,425,426 and in EP Pat. Appln. 84,637.

The exposed light-sensitive materials of this invention can be processed by any of the conventional processing techniques. The processing can be black-and-white photographic processing for forming a silver image or color photographic processing for forming a dye image depending upon the purpose. Such processing techniques are illustrated for example in Research Disclosure, 17643, December 1978. Roller transport processing in an automatic processor is illustrated in U.S. Pat. Nos. 3,025,779, 3,515,556, 3,545,971 and 3,647,459 and in U.K. Pat. No. 1,269,268. Hardening development can be undertaken, as illustrated in U.S. Pat. No. 3,232,761.

The present invention reduces pressure marking in photographic elements comprising silver halide emulsion layer(s) containing tabular silver halide grains. This invention, in particular, is effective for high temperature, accelerated processing times of less than 45 second, preferably of less than 30 seconds, with automatic processors wherein the element is transported automatically and at constant speed from a processing unit to other by means of rollers. Generally, the first unit is the developing unit and preferably the developing bath is a hardener free developing bath. In a preferred embodiment a hardener free aqueous developing solution useful to develop the photographic material of the present invention comprises:

(1) at least one black-and-white developing agent,
(2) at least one black-and-white auxiliary developing agent,
(3) at least one antifoggant,
(4) at least one sequestering agent,
(5) sulfite antioxidants, and
(6) at least one buffering agent.

The developing agents for silver halide photographic elements suitable for the purposes of the present invention include hydroquinone and substituted hydroquinones (e.g. t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydroquinone, etc.). Hydroquinone, however, is preferred. Said silver halide developing agents are generally used in an amount from about 2 to 100 grams per liter, preferably 6 to 50 grams per liter of the ready-to-use developer composition.

Such developing agents can be used alone or in combination with auxiliary developing agents which show a superadditive affect, such as p-aminophenol and substituted p-aminophenol (e.g. N-methyl-p-aminophenol (known as metol) and 2,4-diaminophenol) and pyrazolidones (e.g. 1-phenyl-3-pyrazolidone or phenidone) and substituted pyrazolidones (e.g., 4-methyl-1-phenyl-3-pyrazolidone, 4-hydroxymethyl-4-methyl-1-phenyl-3-pirazolidone (known as dimezone S), and 4,4'-dimethyl-1-phenyl-3-pyrazolidone (known as dimezone). These auxiliary developing agents are generally used in an amount from about 0.1 to 10, preferably 0.5 to 5 grams per liter of ready-to-use developer composition.

The antifogging agents, known in the art to eliminate fog on the developed photographic silver halide films, include derivatives of benzimidazole, benzotriazole, tetrazole, indazole, thiazole, etc. Preferably, the developer comprises a combination of benzotriazole-, indazole- and mercaptoazole-type antifoggants, more preferably a combination of 5-methylbenzotriazole, 5-nitroindazole and 1-phenyl-5-mercaptotetrazole. Other examples of mercaptoazoles are described in U.S. Pat. No. 3,576,633, and other examples of indazole type antifoggants are described in U.S. Pat. No. 2,271,229. More preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and 5-methylbenzotriazole and 1-phenyl-1-H-tetrazole-5-thiol. The most preferred combination is 5-methylbenzotriazole and 1-phenyl-1-H-tetrazole-5-thiol. These mixtures are used in a total amount of from about 0.01 to 5, preferably 0.02 to 3 grams per liter of the ready-to-use developer composition. Of course optimum quantities of each compound and proportion can be found by the skilled in the art to respond to specific technical needs. In particular, 5-methylbenzotriazoles have been found to give the best results when used in mixture with 1-phenyl-1-H-tetrazole-5-thiol, the latter being present in minor amount with respect to the weight of the total mixture, in a percent of less than 20%, preferably less than 10%.

The developer, comprising said antifoggant combination, is advantageously used in a continous transport processing machine at high temperature processing (higher than 30° C.) for processing of X-ray materials without changes in the sensitometric properties of the material, mainly without a substantial increase of the fog of the developed material.

The sequestering agents are known in the art such as, for example, aminopolycarboxylic acids (ethylenediaminotetraacetic acid, diethylenetriaminepentaacetic acid, nitrilotriacetic acid, diaminopropanoltetraacetic acid, etc.), aminopolyphosphonic acids (methylaminophosphonic acid, phosphonic acids described in Research Disclosure 18837 of December 1979, phosphonic acids described in U.S. Pat. No. 4,596,764, etc.), cyclicaminomethane diphosphonic acids (as described in EP Appl. No. 286,874), polyphosphate compounds (sodium hexametaphosphate, etc.), α-hydroxycarboxylic acid compounds (lactic acid, tartaric acid, etc.), dicarboxylic acid compounds (malonic acid, etc.), α-ketocarboxylic acid compounds as disclosed in U.S. Pat. No. 4,756,997 (pyruvic acid, etc.), alkanolamine compounds (diethanolamine, etc.), etc.

The above sequestering agents can be used alone or in combination each other. More preferably, particular mixtures of these sequestering agents are useful to assure strong resistence to air oxidation; such preferred mixtures include mixtures of aminopolycarboxylic acids and cyclicaminomethane diphosphonic acids as disclosed in EP 446,457. Said sequestering agents can be advantageously used in a total amounts of from about 1 to about 60 grams per liter, preferably of from about 2 to about 30 grams per liter of ready-to-use developer. Of course optimum quantities of each compound and proportion can be found by the skilled in the art to respond to specific technical needs. The sequestering agents have been found to increase the stability of the developer over a long period of time.

The term "sulfite antioxidants", is meant those compounds known in the art as capable of generating sulfite ions ($SO_3^-$) in aqueous solutions and include sulfites, bisulfites, metabisulfites (1 mole of metabisulfite forming 2 moles of bisulfite in aqueous solution). Examples of sulfites, bisulfites, and metabisulfites include sodium sulfite, sodium bisulfite, sodium metabisulfite, potassium sulfite, potassium bisulfite, potassium metabisulfite and ammonium metabisulfite. The amount of the total sulfite ions is preferably not less than 0.05 moles, more preferably 0.1 to 1.25 moles, and most preferably 0.3 to 0.9 moles, per liter of developer. The amount of the sulfite ions with respect to the hydroquinone preferably exceeds a molar ratio of 2.5:1 and, more preferably, is between 2.5:1 to 4:1.

The developer can further include a buffer (e.g., carbonic acid salts, phosphoric acid salts, polyphosphates, metaborates, boric acid and boric acid salts). Preferably, the developer does not comprise boric acid and/or boric acid salts. The amount of the buffer with respect to the sulfite preferably exceeds a molar ratio of 0.5:1 and, more preferably, is between 1:1 to 2:1.

The developer can further comprise silver halide solvents. Useful silver halides solvents are solutions or compound well known in the art, such as soluble halide salts, (e.g., NaBr, KCl), thiosulfates (e.g. sodium thiosulfate, potassium thiosulfate and ammonium thiosulfate), sulfites (e.g., sodium sulfite), ammonium salts (e.g. ammonium chloride), thiocyanates (e.g., potassium thiocyanate, sodium thiocyanate, ammonium thiocyanate), thiourea, imidazole compounds (e.g., 2-methylimidazole as described in U.S. Pat. No. 3,708,299) and thioether compounds.

In a preferred embodiment the photographic developer can comprise thiosulfates and thiocyanates, alone or in combination with each other. In a more preferred embodiment the photographic developer comprises alkali metal or ammonium thiosulfates or thiocyanates, alone or in combination with each other. The amount of the silver halide solvent used varies depending on the type of the silver halide solvent. The total amount of the silver halide solvents is generally in the range of from 0.01 to 50 mMoles per liter, more preferably in the range of from 0.1 to 30 mMoles per liter of ready-to-use developer composition.

In the developer composition there are used inorganic alkaline agents to obtain the preferred pH which is usually higher than 10. Inorganic alkaline agents include KOH, NaOH, LiOH, sodium and potassium carbonate, etc.

Other adjuvants well known to the skilled in the art of developer formulation may be added to the developer. These include restrainers, such as the soluble halides (e.g., KBr), solvents (e.g., polyethylene glycols and esters thereof), development accelerators (e.g., polyethylene glycols and pyrimidinium compounds), preservatives, surface active agents, and the like.

The developer is prepared by dissolving the ingredients in water and adjusting the pH to the desired value. The pH value of the developer is in the range of from 9 to 12, more preferably of from 10 to 11. The developer may also be prepared in a single concentrated form and then diluted to a working strength just prior to use. The developer may also be prepared in two or more concentrated parts to be combined and diluted with water to the desired strength and placed in the developing tank of the automatic processing machine.

The second unit is the fixing unit and preferably the fixing bath is a hardener free fixing bath comprising:

(1) at least one fixing agent, (2) at least one acid compound, (3) at least one buffering agent.

The fixing agents for silver halide photographic elements include thiosulfates, such as ammonium thiosulfate, sodium thiosulfate, potassium thiosulfate; thiocyanates, such as ammonium thiocyanate, sodium thiocyanates; sulfites, such as sodium sulfite, potassium sulfite; ammonium salts, such as ammonium bromide, ammonium chloride; and the like.

Acid compounds are sodium or potassium metabisulfates, boric acid, acetic acid, and the like.

The fixing solution further includes a buffer (e.g., carbonic acid salts, phosphoric acid salts, polyphosphates, metaborates, boric acid and boric acid salts, acetic acid and acetic acid salts, and the like).

Other components usually employed in fixing bath are disclosed, for example, in L. F. A. Mason, "Photographic Processing Chemistry", pp. 179–195, Focal Press Ltd., and in D. H. O. John, "Radiographic Processing", pp. 152–178, Focal Press Ltd., London.

In a preferred embodiment the fixing solution does not comprise boric acid and/or boric acid salts. The aim of boric acid is substantially related to its binding properties relative to the aluminum ion (used as gelatin hardener in conventional fixing solutions). If the aluminum is bonded by boric acid, the formation of any gels due to $Al(OH)_3$ is avoided. In the absence of gelatin hardeners containing aluminum, boric acid and/or derivatives thereof can be omitted from the fixing solution, so obtaining a less polluting solution.

The following examples, which better illustrate the present invention, report some experimental data obtained with processing and measurements of normal use in the art. In particular, as regards the resistance to the roller marking and turbidity, samples of the films in the form of sheets were stored for 15 hours at 50° C., exposed to white light and processed in a 3M Trimatic TM XP515 automatic processor. As processing baths were used standard 3M XAD2 developer and 3M XAF2 fixing with and without hardener. The processing times were variable from 25 to 120 sec.

The transporting rollers of the developing unit were intentionally deformed to produce pressure onto the film. At the end of the processing, the roller pressure caused black marks which were more or less evident according to the tendency of the film to register the defect: a scholastic evaluation was given to the film resistance to pressure marking and turbidity by giving a 3-mark to those films which had many pressure marking defects and were very turbid, an 8-mark to those films which had no defects and intermediate marks to intermediate situations.

The swelling index and the melting time were measured as previously defined.

The hardness was measured with an instrument provided with a stylus which engraves the sample imbibed for a given time at a given temperature into a liquid composition (water or developing solution). The hardness values are expressed in grams loaded on the stylus to engrave the sample: the higher the weight, the higher the hardness of the element.

EXAMPLE 1

A tabular grain silver bromide emulsion (having an average diameter:thickness ratio of 8:1, prepared in the presence of a deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$) was optically sensitized to green light with a cyanine dye and chemically sensitized with sodium p-toluenethiosulfonate, sodium p-toluensulfinate and benzothiazoleiodoethylate. At the end of the chemical digestion, non-deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$) was added to the emulsion in an amount to have 83% by weight of deionized gelatin and 17% by weight of non-deionized gelatin. The emulsion, containing a wetting agent and 5-methyl-7-hydroxytriazaindolizine stabilizer, was divided into four portions. The four portions were added with the hardener indicated in Table 1. Each portion was coated, at the indicated pH, on each side of a blue polyester film support at a silver coverage of 2 g/m² and gelatin coverage of 1.6 g/m² per side. A non-deionized gelatin protective supercoat containing 1.1 g/m² of gelatin per side and the hardener indicated in Table 1 was applied on each coating at the pH of the emulsion (films A to D). The films A to D in the form of sheets were stored for 15 hours at 50° C., exposed to white light and processed in a 3M Trimatic TM XP515 automatic processor, by developing for 27 seconds at 35° C. with a 3M XAD2 developer having the following formulation:

| | | |
|---|---|---|
| Water | g | 700 |
| $NaS_2O_5$ | g | 40 |
| KOH 35% (w/w) | g | 107 |
| Boric Acid | g | 1.7 |
| $CH_3COOH$ | g | 9 |
| $K_2CO_3$ | g | 13 |
| Glutaraldehyde | g | 7.2 |
| Ethyleneglycol | g | 18 |
| EDTA.4Na | g | 2.2 |
| 5-Methylbenzotraizole | mg | 0.080 |
| 5-Nitroindazole | mg | 0.160 |
| Hydroquinone | g | 28.7 |
| Phenidone | g | 1.45 |
| Sodium bromide | g | 5 |
| Water to make | l. | 1 |
| pH at 20° C. | | 10.10 |

then fixing for 27 seconds at 30° C. with a 3M XAF2 fixer having the following formulation:

| | | |
|---|---|---|
| Water | g | 75 |
| $(NH_4)_2S_2O_3$ | g | 145 |
| $Na_2SO_3$ | g | 8 |
| Boric acid | g | 7 |
| $NH_4OH$ (25%) | g | 17 |
| $CH_3COOH$ | g | 22.5 |
| Alluminium sulfate | g | 7.74 |
| $H_2SO_4$ | g | 3.58 |
| 2-Phenoxyethanol | g | 0.118 |

and washing with water for 22 seconds at 35° C. and drying for 22 seconds at 35° C.

The sensitometric and physical results are tabulated in the following Table 1.

TABLE 1

| Film | A (Comp.) | B (Inv.) | C (Comp.) | D (Inv.) |
|---|---|---|---|---|
| Coating pH | 8.2 | 8.2 | 6.7 | 6.7 |
| Bisvinylsulfonylethylether (hardener) g/m² | | | | |
| emulsion layer | 0.11 | — | 0.11 | — |
| protective layer | 0.064 | — | 0.064 | — |
| 1,3-Bisvinylsulfonyl-2-propanol (hardener) g/m² | | | | |
| emulsion layer | — | 0.11 | — | 0.11 |
| protective layer | — | 0.064 | — | 0.064 |
| D.min | 0.21 | 0.21 | 0.20 | 0.20 |
| Blue speed* | 2.01 | 2.00 | 1.99 | 1.98 |
| Green speed* | 2.42 | 2.40 | 2.40 | 2.38 |

TABLE 1-continued

| Film | A (Comp.) | B (Inv.) | C (Comp.) | D (Inv.) |
|---|---|---|---|---|
| T8 speed* | 2.55 | 2.54 | 2.53 | 2.52 |
| Average contrast | 2.40 | 2.40 | 2.50 | 2.50 |
| Hardness: | | | | |
| water | 44 | 45 | 39 | 40 |
| developer | 47 | 53 | 41 | 46 |
| Melting time | <45' | >45' | 18' | 60' |
| Swelling index | 150% | 125% | 170% | 135% |
| Pressure marking | 5 | 8 | 3 | 8 |
| Turbidity | 5 | 8 | 3 | 8 |

*Blue Speed and Green Speed are the relative sensitivities expressed in logE (wherein E is the exposure in meter-candle-seconds) for films exposed, respectively, to blue and green light and T8 speed is the relative sensitivity for films exposed to X-rays in contact with 3M Trimax TM T8, all measures at 0.25 above fog.

The data of Table 1 clearly show the improvement in pressure marking using films B and D having both the requirement of the present invention. Films A and C show severe problems of pressure marking. An increased amount of bisvinylsulfonylethylether hardener showed a worsening of sensitometric characteristics.

EXAMPLE 2

A set of cubic and tabular silver halide grain emulsions indicated in table 2 were prepared in the presence of a deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$.

TABLE 2

| Emulsion | 1 | 2 | 3 | 4 | 5 |
|---|---|---|---|---|---|
| Shape | Cubic | Tabular | Tabular | Tabular | Tabular |
| Composition | AgBrI | AgBr | AgBr | AgBr | AgBrI |
| I % | 2.3 | — | — | — | 0.8 |
| Diameter | 0.7 | 1.34 | 1.71 | 1.48 | 1.22 |
| Thickness | — | 0.19 | 0.17 | 0.26 | 0.26 |
| Aspect ratio | — | 7.05 | 10 | 5.69 | 4.69 |
| Projective area | — | >50% | >50% | >50% | >50% |

Projective area and aspect ratio are obtained by considering all the grains having a thickness of less than 0.4 micrometers. If we consider all the grains having a thickness of less than 0.2 micrometers the aspect ratio and the projected area of emulsion 4 are respectively 6.6 and less than 5%, and the aspect ratio and the projected area of emulsion 5 are respectively 7.28 and 10%.

The above emulsions were chemically sensitized with sodium p-toluenthiosulfonate, sodium p-toluensulfinate and benzothiazoleiodoethylate and optically sensitized to green light with a cyanine dye and potassium iodide. At the end of the chemical digestion, non-deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$) was added to the emulsion in an amount to have 83% by weight of deionized gelatin and 17% by weight of non-deionized gelatin. The emulsions were combined with a wetting agent and 5-methyl-7-hydroxytriazaindolizine stabilizer. Each emulsion was added with 3.5% by weight (relative to gelatin) of the hardener indicated in Table 3 and then coated, at pH=6.7, on each side of a blue polyester film support at a silver coverage of 2.05 g/m² and gelatin coverage of 2.85 g/m² per side. A non-deionized gelatin protective supercoat containing 0.91 g/m² of gelatin per side and 2% by weight (relative to gelatin) of the hardener indicated in Table 3 was applied on each coating at pH=6.7. The films in the form of sheets were stored for 15 hours at 50° C., exposed to white light and processed in processor 1 and 2. Processor 1 is a 3M Trimatic TM XP515 automatic processor using a 3M XAD2 developer and 3M XAF2 fixer (having both the formulations of example 1) with a total processing time of 90 sec. Processor 2 is a 3MTrimatic TM XP515 without drying system and without hardener in developer and fixer. The processing time of processor 2 is variable and indicated in each following table. The development, fixing and washing time with respect of the total processing time are respectively in the range of from 25% to 40%, preferably the developing time being about 35%, the fixing time being about 35%, and the washing time being about 30% of the total processing time.

TABLE 3

| Films | Emulsion | Hardener | Melting time | Swell index |
|---|---|---|---|---|
| B (c) | 1 | b | 9 min. | 178% |
| C (i) | 2 | a | 56 min. | 120% |
| D (i) | 2 | 1 | 65 min. | 106% |
| G (c) | 2 | c | 20 min. | 120% |
| I (c) | 1 | 1 | 40 min. | 150% |
| J (i) | 4 | 1 | 68 min. | 110% |
| K (i) | 5 | 1 | 60 min. | 115% |
| V (c) | 3 | c | 14 min. | 158% |
| Z (i) | 3 | 1 | 49 min. | 121% |

(c) = comparison
(i) = invention

Hardener 1 is the 1,3-bisvinylsulfonyl-2-propanol according the formula of the present invention as for example 1, hardener a is a 2,4-dichloro-6-hydroxy-1,3,5-triazine, hardener b is a dimethylolurea, and hardener c is the bisvinylsulfonylethylether of example 1.

The sensitometric and physical results obtained with processor 1 are tabulated in the following Table 4. The residual stain evaluation is expressed by scholastic score (6=very good, 5=good 4=sufficient, 3=slightly insufficient 2=inadequate).

TABLE 4

| Films | D.min | D.max | Contrast | Speed | Residual Stain |
|---|---|---|---|---|---|
| B (c) | 0.21 | 3.5 | 2.7 | 100 | 6 |
| C (i) | 0.21 | 3.7 | 2.65 | 95 | 6 |
| D (i) | 0.21 | 3.7 | 2.6 | 100 | 6 |
| G (c) | 0.22 | 3.65 | 2.5 | 105 | 4 |
| I (c) | 0.21 | 3.5 | 2.6 | 95 | 2 |
| J (i) | 0.22 | 3.7 | 2.65 | 100 | 6 |
| K (i) | 0.22 | 3.7 | 2.30 | 110 | 6 |
| V (c) | 0.21 | 3.7 | 2.65 | 100 | 6 |
| Z (i) | 0.22 | 3.7 | 2.55 | 105 | 3 |

(c) = comparison
(i) = invention

The data of table 4 clearly show that the films C, D, J and K of the present invention have physical and sensitometric characteristics equal to or better than the comparison films with respect to the properties measured. Film Z also shows good sensitometric results and has a low residual stain evaluation.

In the following table 5 are tabulated the processing times needed to get the same value of standard sensitometry of table 4 for each sample using processor 2.

TABLE 5

| Films | Processing time | Contrast diff. at 25" | Speed diff. at 25" |
|---|---|---|---|
| B (c) | 90" | +0.03 | −0.13 |
| C (i) | 35" | −0.02 | 0 |
| D (i) | 25" | −0.02 | 0 |

TABLE 5-continued

| Films | Processing time | Contrast diff. at 25" | Speed diff. at 25" |
|---|---|---|---|
| G (c) | 35" | −0.04 | −0.02 |
| I (c) | 75" | −0.05 | −0.08 |
| J (i) | 25" | +0.05 | 0 |
| K (i) | 25" | +0.05 | 0 |
| V (c) | 55" | −0.1 | −0.09 |
| Z (i) | 35" | −0.2 | −0.05 |

Table 5 clearly shows that the emulsions C, D, J, and K of the present invention have the best performances in terms of requested processing time.

Moreover, it is worth noting that in comparing films I and Z, comprising hardener 1 and, respectively, films B and V comprising hardener b or c, the physical and sensitometric characteristics became better, but these films need a longer processing time than film D. Moreover, the film D, having all the requirements of the present invention, shows also better sensitometric and physical characteristics than film G, comprising a comparison hardener. In comparing film G and Z, film G shows, in spite of having similar sensitometric characteristics, very serious problems in roller mark. As disclosed in Example 1 the use of hardener c causes severe problems in roller mark. These problems could be overcome by increasing the amount of hardener but in this case the sensitometric results would be worsened.

EXAMPLE 3

A set of films were prepared as for film D of example 2, but with decreasing quantity of hardener.

TABLE 6

| Films | Emulsion | Hardener 1 |
|---|---|---|
| L | 2 | −10% |
| M | 2 | −20% |
| N | 2 | −40% |
| O | 2 | −50% |

Another set of films were prepared as for film D of example 2, but at different coating pH.

TABLE 7

| Films | Emulsion | Coating pH |
|---|---|---|
| P | 2 | 5.5 |
| Q | 2 | 6.0 |
| R | 2 | 6.5 |
| S | 2 | 7.0 |
| T | 2 | 7.5 |

The so obtained films were stored and exposed as for example 2 and processed in processor 2 without any drying system and without hardener in the developer and the fixer, to fully evaluate their drying properties by measuring the minimum time required to get the film dry. The following table 8 shows the results.

TABLE 8

| Films | Processing time |
|---|---|
| D (i) | 75 |
| G (c) | 90 |
| L (i) | 80 |
| M (i) | 85 |
| N (c) | 105 |
| O (c) | 120 |
| P (i) | 85 |
| Q (i) | 80 |
| R (i) | 75 |
| S (i) | 75 |
| T (i) | 75 |

TABLE 8-continued

| Films | Processing time |
|---|---|
| V (c) | 120 |
| Z (i) | 85 |

(c) = comparison
(i) = invention

Film D has the lowest processing time. The data of films P to T show that higher coating pH significantly improves the hardening reaction. The results of films L to O show that a reduction of the quantity of hardener affects the drying after processing.

EXAMPLE 4

A comparison film F was prepared as for film D of example 2, but using non-deionized gelatin. The films were stored and exposed as for example 2 and processed for 25" in processor 2.

The sensitometric results are tabulated in the following Table 9.

TABLE 9

| Films | D.min | D.max | Contrast | Speed | Residual Stain |
|---|---|---|---|---|---|
| F | 0.22 | 3.5 | 2.3 | 90 | 4 |
| D | 0.21 | 3.7 | 2.6 | 100 | 6 |

The data of table 9 clearly show the better results obtained with film D vs. film F. Non-deionized gelatin does not perform as well as deionized gelatin in very short processing times.

We claim:

1. A light-sensitive silver halide photographic element comprising a support and silver halide emulsion layer or layers, wherein at least one of said silver halide emulsion layers contains tabular silver halide grains having an average diameter to thickness ratio of at least 3:1 and highly deionized gelatin and wherein said photographic element shows a swelling index lower than 140% and a melting time of from 45 to 120 minutes, wherein at least one of said silver halide emulsion layer or layers is hardened with a bi-, tri-, or tetra-vinylsulfonyl substituted organic hydroxy compound of formula $(CH_2{=}CH{-}SO_2{-})_n{-}A$, wherein A is an n-valent organic group containing at least one hydroxy group and n is 2, 3, or 4.

2. The light-sensitive silver halide photographic element of claim 1 wherein the group A is selected from the group consisting of n-valent acyclic hydrocarbon group, 5 or 6 membered heterocyclic group containing a nitrogen, oxygen or sulfur atom, 5 or 6 membered alicyclic group, and aralkylene group having at least 7 carbon atoms.

3. The light-sensitive silver halide photographic element of claim 1, wherein n is 2 and the group A is a divalent acyclic hydrocarbon group having 1 to 8 carbon atoms, or an aralkylene group having a total of 8 to 10 carbon atoms.

4. The light-sensitive silver halide photographic element of claim 1 wherein group A is selected from the group consisting of a divalent acyclic hydrocarbon group having 1 to 8 carbon atoms and an aralkylene group having a total of 8 to 10 carbon atoms wherein one to three of the carbon atoms of said group A are replaced by a hetero atom.

5. The light-sensitive silver halide photographic element of claim 1, wherein said bi-, tri-, or tetra-vinylsulfonyl substituted organic hydroxy compound is used in an amount of from 0.5 to 10% by weight of highly deionized gelatin.

6. The light-sensitive silver halide photographic element of claim 1, wherein said highly deionized gelatin has a $Ca^{++}$ content lower than 50 ppm.

7. The light-sensitive silver halide photographic element of claim 1, wherein the total silver to gelatin ratio is lower than 1.

8. The light-sensitive silver halide photographic element of claim 1, wherein the silver to gelatin ratio of said silver halide emulsion layer is in the range of from 1 to 1.5.

9. The light-sensitive silver halide photographic element of claim 1, wherein the silver coverage is in the range of from 1 to 5 $gAg/m^2$.

10. The light-sensitive silver halide photographic element of claim 1, wherein said tabular silver halide grains have an average diameter:thickness ratio of 3:1 to 8:1.

11. The light-sensitive silver halide photographic element of claim 1, wherein said tabular silver halide grains have an average diameter ranging from about 0.3 to 5 micrometers.

12. The light-sensitive silver halide photographic element of claim 1, wherein said tabular silver halide grains have an average thickness of 0.4 micrometers or less.

13. The light-sensitive silver halide photographic element of claim 1, wherein not less than 40% of the silver halide grains are tabular silver halide grains having an average diameter:thickness ratio of at least 3:1.

14. The light-sensitive silver halide photographic element of claim 1, wherein said silver halide grains are silver bromide or silver bromoiodide grains.

15. The light-sensitive silver halide photographic element of claim 14, wherein said silver bromoiodide grains comprise an amount of from 0.5 to 1.5 mol % of iodide relative to the total halide content.

* * * * *